US009732472B2

(12) United States Patent
Pal et al.

(10) Patent No.: US 9,732,472 B2
(45) Date of Patent: Aug. 15, 2017

(54) COMPOSITION AND METHOD FOR TREATING MEDIA

(75) Inventors: Lokendra Pal, San Diego, CA (US); Xulong Fu, San Diego, CA (US); Xiaoqi Zhou, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 423 days.

(21) Appl. No.: 14/375,433

(22) PCT Filed: Feb. 10, 2012

(86) PCT No.: PCT/US2012/024653

§ 371 (c)(1),
(2), (4) Date: Jul. 29, 2014

(87) PCT Pub. No.: WO2013/119246

PCT Pub. Date: Aug. 15, 2013

(65) Prior Publication Data

US 2015/0007749 A1 Jan. 8, 2015

(51) Int. Cl.

| | |
|---|---|
| ***D21H 17/13*** | (2006.01) |
| ***D21H 17/14*** | (2006.01) |
| ***D21H 19/44*** | (2006.01) |
| ***D21H 21/30*** | (2006.01) |
| ***D21H 19/32*** | (2006.01) |
| ***D21H 19/10*** | (2006.01) |
| ***B41M 5/00*** | (2006.01) |

(Continued)

(52) U.S. Cl.

CPC ..... *D21H 17/13* (2013.01); *B41M 5/0035* (2013.01); *B41M 5/52* (2013.01); *B41M 5/5218* (2013.01); *B41M 5/5227* (2013.01); *D06P 5/30* (2013.01); *D21H 17/14* (2013.01); *D21H 19/10* (2013.01); *D21H 19/32* (2013.01); *D21H 19/44* (2013.01); *D21H 21/30* (2013.01)

(58) Field of Classification Search

CPC ..... D21H 17/14; D21H 17/19; D21H 19/10; D21H 19/32; D21H 19/44; D21H 21/30; D06P 5/30

See application file for complete search history.

(56) References Cited

U.S. PATENT DOCUMENTS

| | | | |
|---|---|---|---|
| 6,607,269 | B2 | 8/2003 | Sumioka et al. |
| 6,905,729 | B2 | 6/2005 | Wickramanayake |
| 7,223,453 | B2 | 5/2007 | Takashima et al. |

(Continued)

FOREIGN PATENT DOCUMENTS

| | | |
|---|---|---|
| CN | 101942230 | 1/2011 |
| CN | 101959694 | 1/2011 |

(Continued)

OTHER PUBLICATIONS

International Search Report and The Written Opinion (ISRWO) of the International Searching Authority (ISA/KR) dated Oct. 24, 2012 (8 pages) for counterpart International application No. PCT/US2012/024653.

*Primary Examiner* — Jun Li

(74) *Attorney, Agent, or Firm* — HP Inc. Patent Department

(57) ABSTRACT

Described herein is a composition that can be used for treating media. The composition includes an organosilane treated water dispersible organic acid salt, a water soluble organic acid salt, a chelating agent, and an optical brightening agent.

14 Claims, 1 Drawing Sheet

| Solution | Calcium Acetate Hydrate | Calcium Citrate Tetrahydrate | Silquest A1100® Silane | Extra White® Chelant | Tinopal® SFP LIQ OBA | Penford Gum® 280 Starch | Mowiol® 40-88 PVA |
|---|---|---|---|---|---|---|---|
| 1 | 1.50 | 1.50 | 0.15 | 0.15 | 0.3 | 0 | 2.4 |
| 2 | 2.25 | 0.75 | 0.15 | 0.15 | 0.3 | 0 | 2.4 |
| 3 | 2.70 | 0.30 | 0.15 | 0.15 | 0.3 | 0 | 2.4 |
| 4 | 0.5 | 0.5 | 0.15 | 0.15 | 1 | 3.70 | 0 |
| 5 | 1.0 | 0.5 | 0.15 | 0.15 | 1 | 3.20 | 0 |
| 6 | 2.0 | 0.5 | 0.15 | 0.15 | 1 | 2.20 | 0 |
| 7 | 0.5 | 0.5 | 0.30 | 0.15 | 1 | 3.55 | 0 |
| 8 | 1.0 | 0.5 | 0.30 | 0.15 | 1 | 3.05 | 0 |
| 9 | 2.0 | 0.5 | 0.15 | 0.30 | 1 | 2.05 | 0 |
| 10 | 1.50 | 1.50 | 0.15 | 0.60 | 1 | 1.75 | 0 |
| 11 (Control) | 0 | 0 | 0 | 0 | 0 | 6.00 | 0 |

| Solution | Black Color Optical Density (KoD) | CIE Whiteness |
|---|---|---|
| 1 | 1.41 | 165.2 |
| 2 | 1.44 | 162.4 |
| 3 | 1.43 | 165.0 |
| 4 | 1.18 | 156.0 |
| 5 | 1.33 | 151.4 |
| 6 | 1.40 | 149.6 |
| 7 | 1.27 | 160.7 |
| 9 | 1.37 | 153.6 |
| 10 | 1.37 | 156.8 |
| 11 (Control) | 1.03 | 160.0 |

(51) Int. Cl.
*B41M 5/52* (2006.01)
*D06P 5/30* (2006.01)

(56) References Cited

U.S. PATENT DOCUMENTS

| | | | | |
|---|---|---|---|---|
| 7,744,179 | B2 | 6/2010 | Doi et al. | |
| 7,744,959 | B2 | 6/2010 | Bi et al. | |
| 2003/0198759 | A1* | 10/2003 | Fruge | B41M 5/5218 428/32.1 |
| 2005/0281964 | A1 | 12/2005 | Yamamoto et al. | |
| 2009/0317549 | A1 | 12/2009 | Tan et al. | |
| 2010/0026773 | A1 | 2/2010 | Schultz et al. | |
| 2011/0003097 | A1 | 1/2011 | Chen et al. | |

FOREIGN PATENT DOCUMENTS

| | | | |
|---|---|---|---|
| CN | 102245719 | | 11/2011 |
| WO | 0112446 | A1 | 2/2001 |
| WO | 2008044616 | A1 | 4/2008 |
| WO | WO-2009110910 | | 9/2009 |
| WO | WO-2010068193 | | 6/2010 |
| WO | WO-2011156438 | | 12/2011 |

* cited by examiner

| Solution | Calcium Acetate Hydrate | Calcium Citrate Tetrahydrate | Silquest A1100® Silane | Extra White® Chelant | Tinopal® SFP LIQ OBA | Penford Gum® 280 Starch | Mowiol® 40-88 PVA |
|---|---|---|---|---|---|---|---|
| 1 | 1.50 | 1.50 | 0.15 | 0.15 | 0.3 | 0 | 2.4 |
| 2 | 2.25 | 0.75 | 0.15 | 0.15 | 0.3 | 0 | 2.4 |
| 3 | 2.70 | 0.30 | 0.15 | 0.15 | 0.3 | 0 | 2.4 |
| 4 | 0.5 | 0.5 | 0.15 | 0.15 | 1 | 3.70 | 0 |
| 5 | 1.0 | 0.5 | 0.15 | 0.15 | 1 | 3.20 | 0 |
| 6 | 2.0 | 0.5 | 0.15 | 0.15 | 1 | 2.20 | 0 |
| 7 | 0.5 | 0.5 | 0.30 | 0.15 | 1 | 3.55 | 0 |
| 8 | 1.0 | 0.5 | 0.30 | 0.15 | 1 | 3.05 | 0 |
| 9 | 2.0 | 0.5 | 0.15 | 0.30 | 1 | 2.05 | 0 |
| 10 | 1.50 | 1.50 | 0.15 | 0.60 | 1 | 1.75 | 0 |
| 11 (Control) | 0 | 0 | 0 | 0 | 0 | 6.00 | 0 |

FIGURE 1

| Solution | Black Color Optical Density (KoD) | CIE Whiteness |
|---|---|---|
| 1 | 1.41 | 165.2 |
| 2 | 1.44 | 162.4 |
| 3 | 1.43 | 165.0 |
| 4 | 1.18 | 156.0 |
| 5 | 1.33 | 151.4 |
| 6 | 1.40 | 149.6 |
| 7 | 1.27 | 160.7 |
| 9 | 1.37 | 153.6 |
| 10 | 1.37 | 156.8 |
| 11 (Control) | 1.03 | 160.0 |

FIGURE 2

COMPOSITION AND METHOD FOR TREATING MEDIA

BACKGROUND

Media used for printing is traditionally made from the intermeshed cellulose fibers of wood pulp. This use of wood pulp consumes a sizable number of the world's trees. Global environmental pressures have forced the paper industry to use recycled fibers and non-wood pulp for its media. When used in digital printing applications, such as inkjet printing, media made from recycled fibers and synthetic fibers of non-wood pulp suffer from poor performance.

DESCRIPTION OF THE DRAWINGS

FIG. 1 is a table of exemplary compositions for treating media.

FIG. 2 is a table illustrating paper qualities (Black Color Optical Density (KoD) and CIE Whiteness) for the exemplary compositions for treating media.

DETAILED DESCRIPTION

Described herein is a composition for treating media used for printing. The composition includes an organosilane treated organic acid salt, a chelating agent, and an optical brightening agent (OBA). Treatment with the composition can improve performance of the media in ink jet printing applications.

The term "ink jet printing" generally refers to a digital printing operation in which a fluid is dispensed on a medium. Examples of fluids used in ink jet printing applications include ink, dye, pigment, or the like.

The term "media" includes any type of media used for ink jet printing applications. Generally, the term "media" encompasses a substrate of any dimension based on cellulosic fibers, other known paper fibers, and/or printing substrate material (such as a banner, sign, label, and the like). "Media" includes paper made from cellulose fibers of wood pulp, paper made from recycled fibers, paper made from synthetic fibers, or the like. The media can be of any dimension (size, thickness, or the like). The media can also be of any form (pulp, wet paper, dry paper, or the like). As an example, media can be in the form of a flat or sheet structure of variable dimensions.

Compared to media made from cellulose fibers of wood pulps, media made from recycled fibers and synthetic fibers of non-wood pulp generally exhibit less desirable paper quality. Media made from recycled fibers and synthetic fibers often exhibit a lower whiteness and a reduced brightness compared to media made from cellulose fibers of wood pulps. Whiteness is a measurement of light reflectance across all wavelengths of light in the full visible spectrum. Brightness is a measurement of light reflectance of 475 nm wavelength blue light.

In ink jet printing applications, media made from recycled fibers and synthetic fibers often exhibit poor optical density compared to media made from cellulose fibers of wood pulps. Optical density refers to the fullness and intensity characteristics of an inkjet ink after application to a media. The fullness and intensity are generally a measure of the concentration of ink at a given point on a media.

Media made from recycled fibers and synthetic fibers often exhibit ink over-absorption and poor ink penetration compared to media made from cellulose fibers of wood pulps. Ink over-absorption, poor penetration, and associated ink bleed can lead to a poor optical density. Media made from recycled fibers and synthetic fibers can also exhibit a poor color gamut compared to media made from cellulose fibers of wood pulp.

Due to the shortcomings of media made from recycled fibers and synthetic fibers, the paper industry uses treatments that aim to improve inkjet printing performance. For example, calcium chloride treatments can be applied to media in order to improve inkjet printing performance. However, calcium chloride treatment has several drawbacks. One significant drawback is reduced whiteness and/or brightness caused by quenching. Use of inorganic anions (inherently in calcium chloride treatments) also raises concerns about corrosion.

A composition for treating media using an organic acid salt with an organic anion eliminates corrosion concerns brought about by inorganic anions. The organic acid salt is treated with organosilane to reduce the quenching effect of previous treatments. Media treated with a composition that includes an organosilane treated organic acid salt, a chelating agent, and an OBA exhibit higher whiteness and brightness compared to untreated media. Treated media also exhibit improved inkjet printing performance, such as a higher optical density and a better color gamut.

Media made from recycled fibers or synthetic fibers treated with the composition for treating media can exhibit improved characteristics including whiteness, brightness, optical density and color gamut. Treatment of media with the composition for treating media can facilitate or accelerate the transition from paper made from cellulose fibers of wood pulps to more environmentally friendly paper made from recycled fibers or synthetic fibers.

The composition for treating media includes an organosilane treated organic acid salt. The organosilane treated organic acid salt can be present in the composition for treating media in a sufficient amount to facilitate improved ink jet performance properties, such as higher optical density (KoD), better color gamut, improved whiteness, improved brightness, reduced corrosion, reduced paper greenness or the like. The organosilane treated organic acid salt can be present in the composition for treating media from 0.25% wt. to 3% wt. The organosilane treated organic acid salt can be present in the composition for treating media from 0.3% wt. to 2.75% wt. Further, the organosilane treated organic acid salt can be present in the composition for treating media from 0.5% wt. to 2.5% wt.

The organosilane treated organic acid salt is produced by combining an organic acid salt and organosilane in a suitable carrier, such as an aqueous fluid. The organic acid salt includes an inorganic cation and an organic anion. The inorganic cation can be an alkali metal cation or an alkaline earth metal cation. Examples of inorganic cations include lithium, sodium, potassium, rubidium, cesium, beryllium, magnesium, calcium, strontium, and barium. The organic acid salt can be a multivalent organic acid salt.

The organic anion includes one or more carboxylate groups. A carboxylate group is a functional group containing a carbonyl and a hydroxyl and having the formula $COO^-$. The organic anion with carboxylate group(s) can contain from 1 to 12 carbon atoms. Examples of organic anions include acetate, propionate, formate, citrate, oleate, and oxalate. Use of organic ions minimizes and/or eliminates corrosion, reduces paper greenness and reduces other detrimental effects caused by inorganic anions.

The organic acid salt can include an organosilane treated water dispersible organic acid salt and a water soluble organic acid salt or a combination of an organosilane treated water dispersible organic acid salt and a water soluble organic acid salt.

A water soluble organic acid salt can dissolve in water. Examples of water soluble organic acid salts include inorganic cation acetate, inorganic cation propionate, inorganic cation formate, inorganic cation oxalate, and the like. A water dispersible organic acid salt forms a dispersion of salt particles in water. Examples of water dispersible organic acid salts include an inorganic cation citrate, an inorganic cation oleate, an inorganic cation oxalate, and the like. In an example where the organosilane treated organic acid salt includes both a water soluble organic acid salt and an organosilane treated water dispersible organic acid salt, the water soluble multivalent organic acid salt is calcium acetate and the water dispersible multivalent organic acid salt is calcium citrate.

The organic acid salt can include both a water soluble organic acid salt and an organosilane treated water dispersible organic acid salt. The water soluble organic acid salt and the organosilane treated water dispersible organic acid salt can be present in the composition in ratios sufficient to facilitate improved ink jet performance properties, such as higher optical density, better color gamut, improved whiteness, improved brightness, reduced corrosion, reduced paper greenness or the like. The water soluble organic acid salt and the organosilane treated water dispersible organic salt can be present in a ratio of from 1:1 to 9:1 in the composition for treating media. For example, the water soluble organic acid salt can be present in the composition for treating media from 0.5% wt. to 2.7% wt. and the organosilane treated water dispersible organic acid salt can present in the composition for treating media from 0.3% wt. to 1.5 wt. %.

The organosilane treated organic acid salt is a water dispersible organic acid salt treated with an organosilane. While not wishing to be bound by any theory, it is believed that the organosilane modifies surface properties of the water dispersible organic acid salt so that the organosilane treated water dispersible organic acid salt more readily reacts with the media and/or the ink. The better the reaction between the organosilane treated water dispersible organic salt and the media and/or the ink, the higher likelihood of improved print characteristics, such as optical density, color gamut, bleed control, and the like. Since no inorganic anions are used in the composition, the risk of corrosion and paper greenness is reduced.

Organosilane is represented by the general formula $(RO)_{4-X}SiY_X$, where X is from 1 to 3. Each R is individually a hydrocarbyl group containing from 1 to 12 carbon atoms. Each Y is individually an amino group or a hydrocarbyl group containing from 1 to 12 carbon atoms. The RO groups are hydrolysable in a neutral to acidic environment.

As used herein, the term "hydrocarbyl" means that the group being described has predominantly hydrocarbon character. These include groups that are not only purely hydrocarbon in nature (containing only carbon and hydrogen), but also groups containing substituents or hetero atoms which do not alter the predominantly hydrocarbon character of the group. Such substituents can include halo-, carbonyl-, ester-, ether-, alkoxy-, nitro-, etc. These groups also can contain hetero atoms. Suitable hetero atoms will be apparent to those skilled in the art and include, for example, sulfur, nitrogen and oxygen. Examples of hydrocarbyl groups include alkyl, alkenyl, alkyloxy, aromatic, heteroaromatic, etc.

Examples of organosilane include: a gamma-aminopropyltriethoxy silane, a monoamino silane, a diamino silane, a triamino silane, a bis(2-hydroethyl)-3-aminopropyltriethoxysilane, a 3-mercaptopropyltrimethoxysilane, a 3-glycidoxypropyltrimethoxysilane, a bis(triethoxysilylpropyl)disulfide, a 3-aminopropyltriethoxysilane, a bis-(trimethoxysilylpropyl)amine, an N-phenyl-3-aminopropyltrimethoxysilane, an N-aminoethyl-3-aminopropylmethyldimethoxysilane, a 3-ureidopropyltrimethoxysilane, a 3-methacryloxypropyltrimethoxysilane, an N-(trimethyloxysilylpropyl)isothiouronium chloride, an N-(triethoxysilpropyl)-O-polyethylene oxide, a 3-(triethoxylsilyl)propylsuccinic anhydride, or a 3-(2-imidazolin-1-yl)propyltriethoxysilane, a 3-aminopropyltrimethoxysilane, an N-(2-aminoethyl-3-aminopropyltrimethoxysilane, a 3-(triethoxysilylpropyl)-diethylenetriamine, a poly(ethyleneimine)trimethoxysilane, an aminoethylaminopropyl trimethoxysilane, or an aminoethylaminoethylaminopropyl trimethoxysilane.

Organosilanes are commercially available from a number of sources, including Momentive, Dow Chemical, Silar Laboratories, and the like. Gamma-aminopropyltriethoxysilane is commercially available under the trade name Silquest® A-1100® Silane from Momentive.

The composition for treating media includes a chelating agent. A chelating agent can also be referred to as a chelant, a chelator, or a sequestering agent. In the composition for treating media, the chelating agent decreases the color of the pulp by masking metal ions. Decreasing the color of the pulp increases the whiteness and/or brightness of the media.

Chelating agents include amino and/or carboxyl groups. Amino groups and/or carboxyl groups mask metal ions effectively. Examples of chelants used in the chelating agent include: organic phosphonate, phosphate, carboxylic acid, dithiocarbamate, and the like. A chelating agent that includes one or more chelants is commercially available from Nalco, Inc. under the trade name Extra White® chelant.

The chelating agent can be present in the composition for treating media from 0.01% wt. to 2% wt. In another example, the chelating agent can be present in the composition for treating media from 0.1% wt. to 1% wt. Further, the chelating agent can be present in the composition for treating media from 0.15% wt. to 0.5% wt.

The composition for treating media includes an OBA. The OBA improves whiteness and/or brightness of the media. An OBA absorbs ultraviolet light and re-emits blue light. The blue light is added to the reflected light of the media. The media appears less green and/or yellow because more blue light is reflected. An OBA is also commonly referred to as a fluorescence whitening agent (FWA).

Basic classes of OBA that can be used in the composition for treating media include triazine-stilbenes, coumarins, imidazolines, diazololes, triazoles, benzoxazolines, and biphenyl-stilbenes. Different OBAs are commercially available from a number of sources, including BASF Corporation Clariant Corporation, and the like. Tinopal® SFP is the trade name of an OBA commercially available from BASF Corporation. Leucophor® NS is the trade name of an anionic OBA commercially available from Clariant Corporation.

The OBA is present in the composition for treating media in an amount sufficient to improve whiteness and/or brightness without achieving a greening effect due to quenching. The OBA can be present in the composition for treating media from 0.1% wt. to 2% wt. In another example, the OBA can be present in the composition for treating media from 0.1% wt. to 1% wt. Further, the OBA can be present in the composition for treating media from 0.3% wt. to 1% wt.

Optionally, the composition for treating media can also include a binder. A binder generally refers to components that enhance adhesion. The binder can enhance adhesion between the composition for treating media and the media. The binder can enhance adhesion between the composition for treating media and ink. The binder can also enhance adhesion between the media and ink.

The binder can be water soluble or water dispersible. Examples of a binder include styrene butadiene latex, styrene acrylic, dextrin, starch, polyvinyl acid, or the like.

According to an example, binder can be present in the composition for treating media from 0.1% wt. to 5% wt. In another example, binder can be present in the composition for treating media from 0.5% wt. to 3% wt. Further, the binder can be present in the composition for treating media from 1% wt. to 3% wt. Further, the treating solution is applied to a medium at a dry coat weight from 0.1 $g/m^2$ to 20 $g/m^2$. In another example, the treating solution is applied to the medium at a dry coat weight from 1 $g/m^2$ to 15 $g/m^2$. According to a further example, the treating solution is applied to the medium at a dry coat weight from 2 $g/m^2$ to 10 $g/m^2$.

The composition for treating media can optionally include other components. Generally, the other components are processing aids or materials that further enhance properties of the treated media. Examples of processing aids include defoamers, buffering agents, dyes, surfactants, biocides, wetting agents, antifading agents, viscosity modifiers, ultra violet absorbers, and the like.

The composition for treating media can be made by combining the components in a suitable carrier. The suitable carrier is generally inert and allows for creation of the composition. An example of a suitable carrier is an aqueous solution.

The composition for treating media can be made by combining the water dispersible organic acid salt with the organosilane. The combining the water dispersible organic acid salt with the organosilane can occur in a carrier suitable to facilitate organosilane treatment of the organic acid salt, such as an aqueous fluid.

The organosilane treated water dispersible organic acid salt is combined with the water soluble organic acid salt, the chelating agent, the OBA and any additional components. According to an example, the additional components include a binder. In other examples, the additional components include processing aids or materials that further enhance properties of the treated media.

In an example, the composition for treating media can be produced by mixing the components for a time sufficient for the components to combine completely. The mixing can occur for a time from 5 minutes to 2 hours. In another example, the mixing can occur for a time from 10 minutes to 1 hour. Further, the mixing can occur for a time from 30 minutes to 1 hour.

During mixing, the composition for treating media is held at a temperature greater than room temperature. For example, the composition for treating media can be held at a temperature from 25 degrees C. to 90 degrees C. According to another example, the composition for treating media can be held at a temperature from 30 degrees C. to 80 degrees C.

The media can be contacted with composition for treating media according to a process conducted prior to ink jet application. The process for treating the media can be incorporated into the process of making the media. The process for treating the media can alternatively be performed as an act occurring after the process of making the media, such as a post-production treatment act or a treatment act just before ink application.

The composition for treating media can be incorporated within the media in a manner that can facilitate improved ink jet performance properties, such as higher optical density, better color gamut, improved whiteness, improved brightness, reduced corrosion, reduced paper greenness or the like. The composition for treating media can be a surface coating on a surface of the media. In another example, the composition for treating media can be incorporated within the media. Further, the composition for treating media can be a surface coating of the media and incorporated within the media. According to another example, a portion of the composition for treating media can be incorporated within the media and a portion of the composition for treating media is coated on the surface of the media.

After the media is treated with the composition, the media exhibits improved characteristics compared to untreated media. The improved characteristics include higher whiteness and brightness. The treated media can have higher whiteness at a given OBA level and a reduction and/or elimination of paper greenness, even at high OBA levels. Since no aggressive inorganic anions, such as chloride ions, are used in the composition, the risk of corrosion is reduced.

The treated media also exhibits improved inkjet printing performance compared to untreated media. The treated media exhibits higher optical density and color gamut, as well as better bleed control. The treated media is also environmentally friendly, making the use of recycled fibers and synthetic fibers from non-wood pulps feasible.

EXAMPLES

The following examples are exemplary or illustrative of the application of the principles of the subject innovation. It will be noted that experimental data provided does not limit the scope of the embodiments. Rather, such data merely illustrate the preparation of composition embodiments in accordance with the subject innovation as well as for demonstrating the properties described above illustrating the usefulness of the composition for treating media.

Unless otherwise indicated in the following examples and elsewhere in the specification and claims, all parts and percentages are by weight, all temperatures are in degrees Centigrade, and pressure is at or near atmospheric pressure.

(a) Preparation of the Composition for Treating Media

As illustrated in FIG. 1, ten compositions were prepared at 6% solids in aqueous solution according to the following procedure. The organosilane treated water dispersible organic acid salt was prepared by combining: water, Silquest® A-1100® Silane and calcium citrate water dispersible organic acid salt under high shear mixing. The calcium acetate water soluble organic acid salt, Extra White® chelant, Tinopal® SFP LIQ OBA, and a binder (a starch binder or a polyvinyl acid binder) were then added to the organosilane treated water dispersible organic acid salt solution. The solution was held at a temperature of 65 degrees C. for one hour.

The solution 11 was prepared with 6% starch as a control.

(b) Compositions for Treating Media

A table illustrating a series of compositions prepared according to the procedure described above can be found in FIG. 1.

Solution 1

Solution 1 includes 1.5% wt. calcium acetate, 1.5% wt. calcium citrate, 0.15% wt. Silane A-1100®, 0.15% wt. Extra White®, 0.3% wt. Tinopal® SFP LIQ and 2.4% wt. polyvinyl acid.

Solution 2

Solution 2 includes 2.25% wt. calcium acetate, 0.75% wt. calcium citrate, 0.15% wt. Silane A-1100®, 0.15% wt. Extra White®, 0.3% wt. Tinopal® SFP LIQ and 2.4% wt. polyvinyl acid.

Solution 3

Solution 3 includes 2.70% wt. calcium acetate, 0.30% wt. calcium citrate, 0.15% wt. Silane A-1100®, 0.15% wt. Extra White®, 0.3% wt. Tinopal® SFP LIQ and 2.4% wt. polyvinyl acid.

Solution 4

Solution 4 includes 0.5% wt. calcium acetate, 0.5% wt. calcium citrate, 0.15% wt. Silane A-1100®, 0.15% wt. Extra White®, 1.0% wt. Tinopal® SFP LIQ and 3.7% wt. starch.

Solution 5

Solution 5 includes 1% wt. calcium acetate, 0.5% wt. calcium citrate, 0.15% wt. Silane A-1100®, 0.15% wt. Extra White®, 1.0% wt. Tinopal® SFP LIQ and 3.2% wt. starch.

Solution 6

Solution 6 includes 2.0% wt. calcium acetate, 0.5% wt. calcium citrate, 0.15% wt. Silane A-1100®, 0.15% wt. Extra White®, 1.0% wt. Tinopal® SFP LIQ and 2.2% wt. starch.

Solution 7

Solution 7 includes 0.5% wt. calcium acetate, 0.5% wt. calcium citrate, 0.30% wt. Silane A-1100®, 0.15% wt. Extra White®, 1.0% wt. Tinopal® SFP LIQ and 3.55% wt. starch.

Solution 8

Solution 8 includes 1% wt. calcium acetate, 0.5% wt. calcium citrate, 0.30% wt. Silane A-1100®, 0.15% wt. Extra White®, 1.0% wt. Tinopal® NS LIQ and 3.05% wt. starch.

Solution 9

Solution 9 includes 2% wt. calcium acetate, 0.5% wt. calcium citrate, 0.15% wt. Silane A-1100®, 0.30% wt. Extra White®, 1.0% wt. Tinopal® SFP LIQ and 2.05% wt. starch.

Solution 10

Solution 10 includes 2% wt. calcium acetate, 0.5% wt. calcium citrate, 0.15% wt. Silane A-1100®, 0.60% wt. Extra White®, 1.0% wt. Tinopal® SFP LIQ and 1.75% wt. starch.

Solution 11 (Control)

Solution 11 includes 6% wt. starch as a control media (c) Treating Media with the Composition for Treating Media To apply the composition for treating media, two ends of a sheet of 90 gsm HP LaserJet plain paper were taped to a benchtop drawdown table. The composition for treating media was applied in a thin layer above the paper using a wire-wound metering Mayer rod #8 in a uniform manner. The paper was air-dried using a hand held heat gun. The CIE whiteness was measured using color touch per ISO11475 method.

Afterwards, a known amount of inkjet pigment based black ink was applied to the paper using a Mayer rod #8. The optical density was measured using X-rite 938 with DEN A settings on inked area.

(d) Print Characteristics of the Treated Media

FIG. 2 is a table of print characteristics, including Black Color Optical Density (KoD) and CIE Whiteness, for the media. The treated media generally showed an improved Black Color Optical Density (KoD) compared to the control. The treated media generally showed a similar CIE Whiteness compared to the control. Accordingly, the composition for treating media improved the Black Color Optical Density (KoD) while not hurting CIE Whiteness of the media.

Numerical data, such as temperatures, concentrations, times, ratios, and the like, are presented herein in a range format. The range format is used merely for convenience and brevity. The range format is meant to be interpreted flexibly to include not only the numerical values explicitly recited as the limits of the range, but also to include all the individual numerical values or sub-ranges encompassed within the range as if each numerical value and sub-range is explicitly recited.

When reported herein, any numerical data is meant to implicitly include the term "about." Values resulting from experimental error that can occur when taking measurements are meant to be included in the numerical data.

Many variations and modifications can be made to the above-described examples. All such modifications and variations are intended to be included herein within the scope of the disclosure and protected by the following claims.

What is claimed is:

1. A composition for treating media, comprising:

from about 0.1% wt. to about 5% wt. of an organosilane treated water dispersible organic acid salt;

from about 0.1% wt. to about 5 wt. % of a water soluble organic acid salt;

from about 0.01 wt. % to about 1 wt. % of a chelating agent; and from about 0.1 wt. % to about 2 wt. % of an optical brightening agent, wherein the composition is applied to a medium at a dry coat weight of about 0.1 $g/m^2$ to 20 $g/m^2$, wherein the water dispersible organic acid salt includes a cation citrate, a cation oleate, and a cation oxalate, wherein the water soluble organic acid salt includes a cation acetate, a cation propionate, a cation formate, and a cation oxalate, and wherein the chelating agent includes organic phosphonate, phosphate, carboxylic acid, and dithiocarbamate.

2. The composition of claim 1, further comprising from about 0.1 wt. % to about 5 wt. % of a binder.

3. The composition of claim 1, wherein the organosilane treated water dispersible organic acid salt comprises organosilane having the formula $(RO)_{4-x}SiY_x$, wherein X is 1, 2 or 3, R is a hydrocarbyl group containing 1 to 12 carbon atoms, and Y is an amino group or a hydrocarbyl group containing 1 to 12 carbon atoms.

4. The composition of claim 1, wherein the water soluble or water dispersible organic acid salt comprises a multivalent water soluble or water dispersible organic acid salt.

5. The composition of claim 1, wherein the organosilane is gamma-aminopropyltriethoxysilane.

6. A method of improving inkjet printing performance of a media, comprising:

contacting the composition of claim 1.

7. The method of claim 6, wherein the contacting further comprises coating the composition on a surface of the media.

8. The method of claim 6, wherein the contacting further comprises incorporating the composition within the media.

9. The method of claim 6, wherein the contacting further comprises coating the composition on the surface of the media and incorporating the composition within the media.

10. The method of claim 6, wherein the contacting occurs during a process for making the media.

11. The method of claim 6, wherein the contacting occurs after a process for making the media.

12. The method of making a composition of claim 1, comprising:

pretreating a water dispersible organic acid salt with an organosilane; and combining the pretreated organic acid salt with a water soluble organic acid salt, a chelating agent and from about 0.1 wt. % to about 2 wt. % of an optical brightening agent, wherein the water dispersible organic acid salt includes a cation citrate, a cation oleate, and a cation oxalate, wherein the water soluble organic acid salt includes a cation acetate, a cation propionate, a cation formate, and a cation oxalate, and wherein the chelating agent includes organic phosphonate, phosphate, carboxylic acid, and dithiocarbamate.

13. The method of claim 12, wherein the organosilane is gamma-aminopropyltriethoxysilane.

14. The method of claim 12, wherein the organic acid salt comprises a multivalent water soluble organic acid salt and a multivalent water dispersible organic acid salt.

* * * * *